United States Patent [19]

Shea

[11] 4,039,187

[45] Aug. 2, 1977

[54] GAME TABLE

[76] Inventor: Donald D. Shea, 1016 Leavenworth, Manhattan, Kans. 66502

[21] Appl. No.: 559,129

[22] Filed: Mar. 17, 1975

[51] Int. Cl.[2] ..... A63B 39/00

[52] U.S. Cl. ..... 273/30; 108/64; 273/95 R

[58] Field of Search ..... 273/30, 3 A, 95 D, 95 R, 273/95 G, 136 R, 136 Z, 118 R, 119 R, 120 R, 121 R, 122 R, 123 R, 124 R; 108/1, 3, 6, 4, 8, 10, 7, 2, 66, 119, 124, 125, 9, 11, 12, 13, 64, 160, 66, 59, 63, 64, 105

[56] References Cited

U.S. PATENT DOCUMENTS

| | | | |
|---|---|---|---|
| 2,083,119 | 6/1937 | Hense | 273/110 X |
| 2,234,483 | 3/1941 | Sutton | 108/7 |
| 3,741,130 | 6/1973 | Workman | 108/64 |
| 3,756,166 | 9/1973 | Piketti | 108/6 |

FOREIGN PATENT DOCUMENTS

| | | | |
|---|---|---|---|
| 769,771 | 9/1934 | France | 273/119 R |
| 112,497 | 8/1900 | Germany | 273/120 R |

*Primary Examiner*—Richard C. Pinkham
*Assistant Examiner*—T. Brown

[57] ABSTRACT

A game table, constructed for playing a rebound-type game using a ball and paddle, has a tabletop provided with a recessed center to present a four-sided, upwardly facing, inclined playing surface that defines a rebound zone for the ball when the latter is caused to strike thereagainst. Each quadrant of the tabletop is swingable from its game-playing, inclined position to a second position in which the playing surface thereof is horizontally disposed so that a generally uniform, planar tabletop is presented when all four quadrants of the tabletop are so positioned in order that the game table may be used as a conventional table. Each quadrant of the game table is a self-supporting unit such that the table may be separable into four independent tables for use as four distinct and independent game tables.

10 Claims, 5 Drawing Figures

Fig. 1.
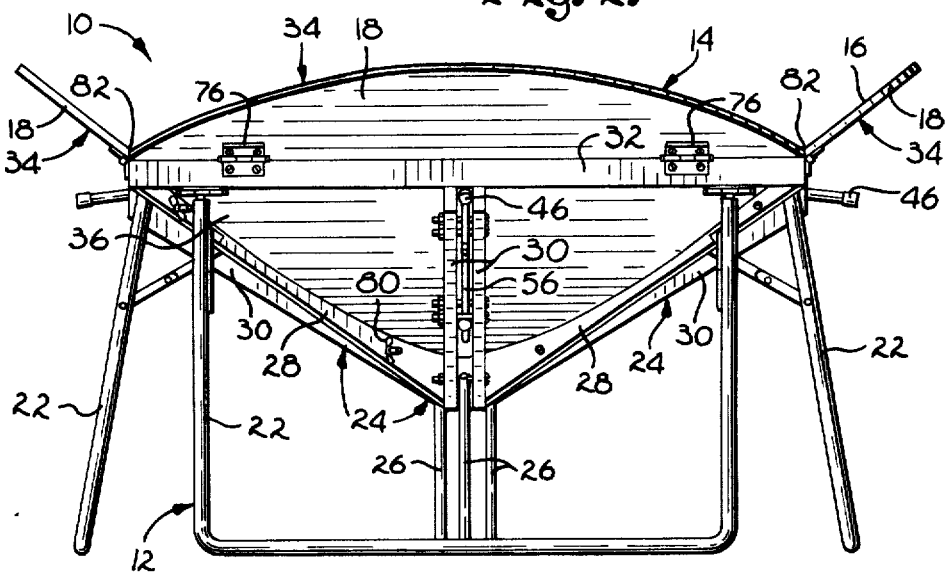
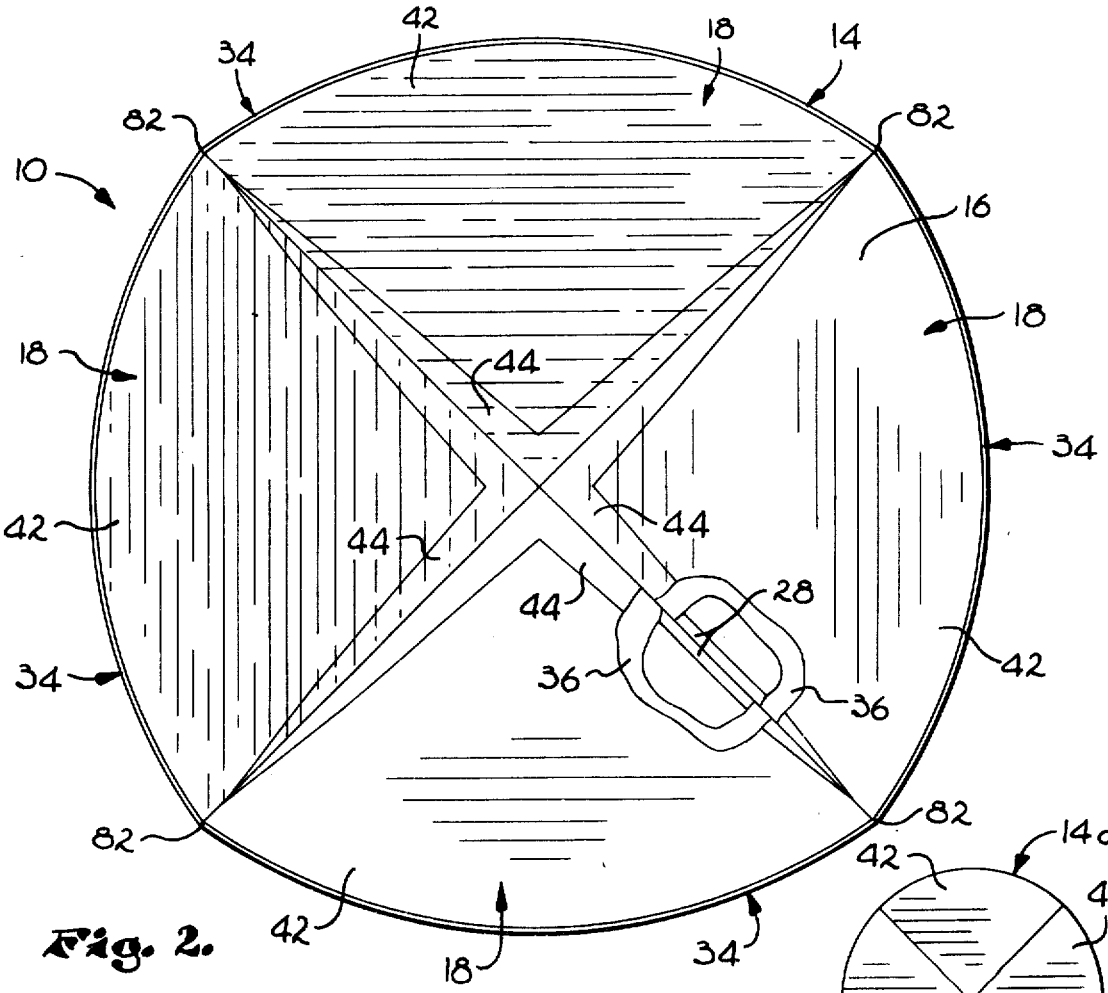
Fig. 2.
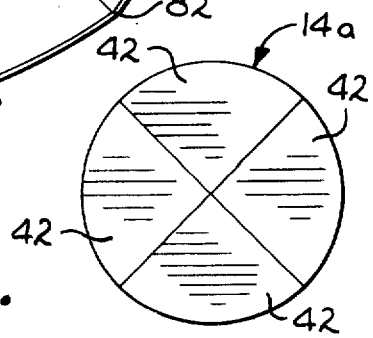
Fig. 3.

GAME TABLE

This invention relates to a game table for playing a rebound-type game to be played by one or more persons using a ball and each person having a paddle.

It is a very important object of my invention to provide a game table for playing a rebound-type game in which a ball is caused to strike an inclined playing surface and rebound therefrom in the general direction of a player for subsequent contact by a paddle or the like held by the player and redirection back toward the playing surface.

Another important object of the invention is to provide a tabletop playing surface for a ball rebounding-type game in which the contour of the playing surface is such that a rebounding ball will follow a generally similar path of travel regardless of whether or not it strikes the playing surface near the center of the tabletop or near the outer periphery thereof.

A further object of the instant invention is to provide a game table for playing a ball rebounding-type game in which the table is suitable for use in connection with a single game played by one to four persons or may be separated and divided into four individual tables in order that up to a total of eight persons might conveniently play four separate games.

Yet another important object of the invention is to provide a game table having a tabletop that may be shifted from its normal game-playing position to a second position in which the tabletop is disposed to present a conventional table that may be used for other purposes than the specific game for which it was designed.

In the drawings:

FIG. 1 is a side elevational view of the game table made pursuant to the present invention in which the tabletop is in its normal, game-playing disposition;

FIG. 2 is a plan view of the game table in its game-playing disposition with a portion of the tabletop broken away to reveal structural details;

FIG. 3 is a plan view, on a reduced scale, of the game table illustrating the tabletop in a second disposition for use as a conventional round table;

Figure 4:
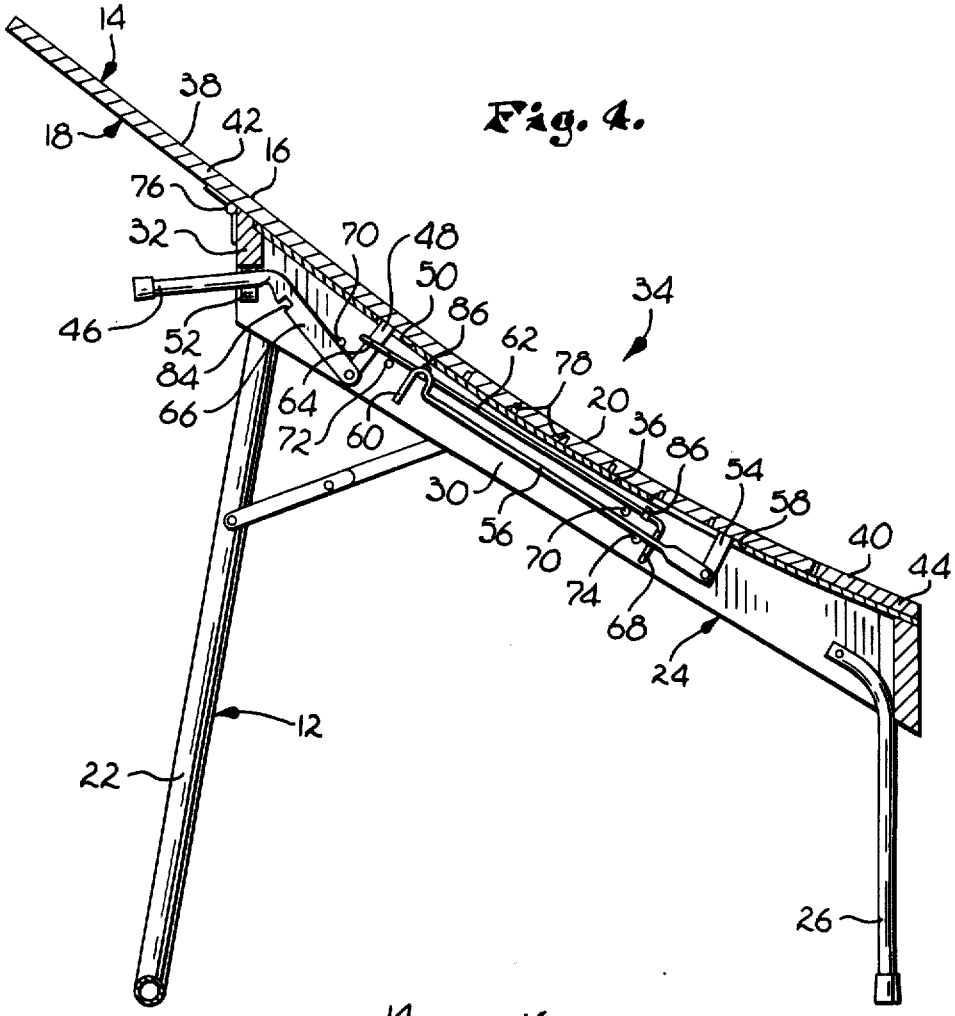
FIG. 4 is an enlarged, vertical, cross-sectional view of one quadrant of the table illustrating the tabletop in its normal game-playing position.

A game table, broadly identified by the numeral 10, is comprised of a support generally denoted by the numeral 12, and a tabletop 14 swingably secured thereto. The tabletop 14 has a recessed center to present an upwardly facing, inclined playing surface 16 sloping upwardly and outwardly from the center to the periphery of the tabletop 14.

The tabletop 14 is comprised of a set of four, generally triangularly-shaped panel members 18 in an adjacent relationship with one another to form a four-sided cup with the members 18 having their respective vertexes at the depressed center of the tabletop 14. The configuration of the depression defined by the four members 18, each one of the members being one quadrant of the tabletop 14, is that of an inverted pyramid.

At least a portion of the playing surface 16 of each member 18 is a shallow, trough-like depression 20 disposed along an axis located across the playing surface 16 of each respective member 18 transversely of the inclined slope thereof. The contour of the depressions 20 can best be seen when viewing FIG. 4. The depressions 20 are all located in a common horizontal plane located generally along the lower half of the playing surface 16 but spaced upwardly a short distance from the recessed center of the tabletop 14. The purpose of the depression 20 will be made clear hereinafter.

The table 10 is separable into individual, self-supporting, independent units 34, each of which have at least one of the members 18 associated therewith. Inasmuch as the units 34 are identical to one another, the description of a single unit 34 will be considered to apply equally to the remaining units.

Each unit 34 includes its own support in the nature of a U-shaped stand 22 and a single leg 26, each of which is pivotally secured to a frame 24 underlying the member 18. The stand 22 is located adjacent and along the normal outer periphery of the member 18, while the leg 26 is adjacent the inner end or vertex thereof. Comprising the frame 24 are a pair of side ribs 28 and a pair of center ribs 30, all of which converge at the vertex of the panel member 18 and are joined together at their opposite outer ends by a reinforcing crosspiece 32 to which the stand 22 is affixed.

The ribs 28 and 30 are contoured along their respective upper edges to correspond with the configuration of the trough-like depression 20 while a sub-panel 36 overlies the ribs 28 and 30 between the same and the member 18. As thus far described, it will be apparent that the playing surface 16 of each member 18 thus presents an upper, sloping, flat portion 38, and a lower, relatively narrow, substantially flat portion 40 adjacent the vertex of the panel member 18 with the depression 20 being located between the two flat portions 38 and 40. It is to be here noted also that the outer periphery of each panel member 18 has been formed in an arcuate contour such that the playing surface 16 of each panel 18 is pie-shaped when viewed in plan.

Figure 5:
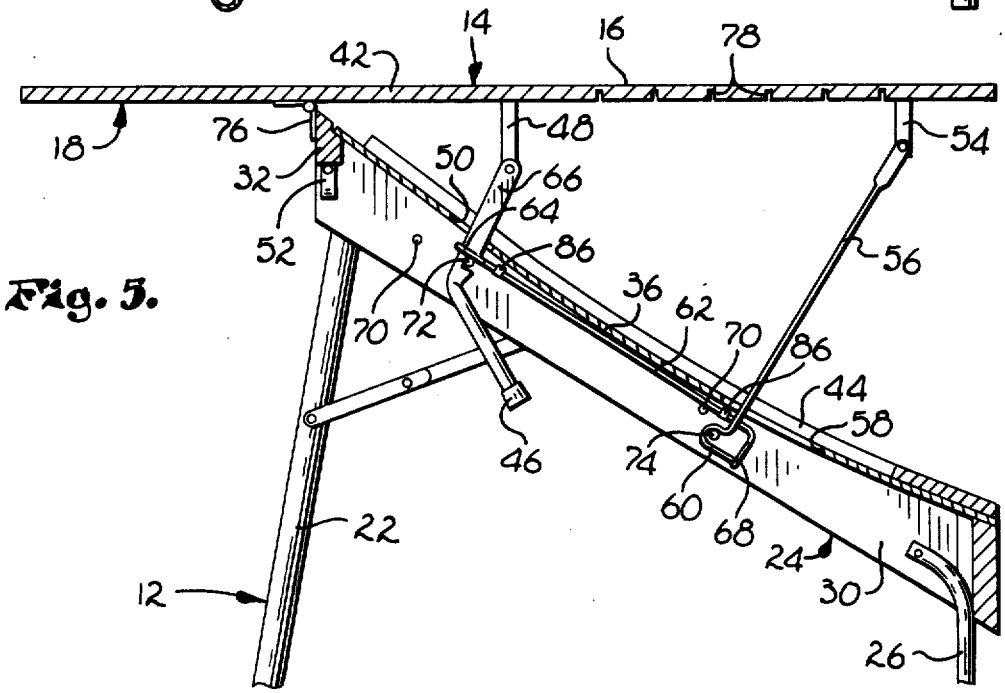
FIG. 5 is a fragmentary, vertical, cross-sectional view similar to FIG. 4 illustrating the tabletop in its second position for use as a conventional table.

Reference to FIG. 5 will reveal that the member 18 includes a section 42 that is swingable relative to the frame 24 from its normal, game-playing position to a second position in which the playing surface 16 thereon is in a generally horizontal, planar disposition. Referring further to FIG. 2, it will be seen that the section 42 of each unit 34 is cut out of the member 18, which may be made of plywood or the like, such that a sharp pointed V segment 44 of the member 18 remains in its normal, game-playing position when the section 42 is raised to a horizontal disposition. It will also be seen with reference to FIG. 2, that the leg portions of each V-shaped segment 44 converge at the vertex of the member 18 and provide the remainder of the playing surface 16 not disposed on the section 42. As shown in FIG. 2, the members 18 are all cut at a 90° angle at the respective vertexes as are the sections 42.

Means for positioning the section 42 at its second position are provided by way of a lever and brace arrangement mounted on the frame 24 between the two longitudinally spaced-apart center ribs 30 beneath the member 18. The positioning arrangement includes a handle 46 swingable about a horizontal axis and is pivotally secured to a downwardly depending bracket 48 attached to the underside of the section 42. An opening 50 in the sub-panel 36 provides clearance for the bracket 48 when the section 42 is in its normal, game-playing position, and a spring clip 52 retains the handle 46 in a locked position as best seen in FIG. 4.

Pivotally secured to a second bracket 54, similar to bracket 48, at a point near the vertex of the section 42, is a brace 56. A second opening 58 in the sub-panel 36 provides clearance for the bracket 54 when the section 42 is in its normal position. A hook 60 is formed in the elongated brace 56 at the opposite, free end of the latter's attachment to the bracket 54. An elongated lever 62 is shiftably secured longitudinally along one of the center ribs 30 and is provided at one end with a loop 64 surrounding an arm 66 of the handle 46, while the opposite end thereof is formed to provide an abutment 68 adjacent the hook 60 when the brace 56 is in a generally upright position during the time that the section 42 is horizontally disposed. Further attention is directed to the series of crossbolts 70, 72 and 74 strategically located along the length of the center ribs 30. The section 42 is secured to the support frame 24 by way of a pair of hinges 76 spaced along the crosspiece 32.

FIGS. 4 and 5 illustrate a series of parallel grooves 78 cut into the underside or the section 42 transversely thereof. The grooves 78 are located along respective axes parallel with the axis of the trough-like depression 20 and directly therebeneath when the section 42 is in its normal, game-playing position.

To use the table 10 in a game situation, four units 34 are bolted together using a plurality of fasteners 80 which extend through the side ribs 28 and adjacent units 34 to form the tabletop 14 with the sections 42 of the members 18 being in their respective first positions such that the tabletop, defined by the four members, presents a center recess having a configuration resembling an inverted pyramid. Four players then position themselves such that there is one player in the vicinity of each corner 82 of the tabletop 14. Each player is supplied with a paddle or racket (not shown) with which to hit a ball (also not shown) such as the kind used for table tennis. One person is designated as the server and hits the ball against the rigid playing surface of one of the two opposite members 18, causing the ball to bounce across the recess, either to the left or to the right, depending on which member 18 the ball bounces from and toward another player who then hits the ball to repeat the action. Thus, the ball bounces from one player to the next until someone misses the ball or the playing surface, giving a point to the other side.

The playing surface 16 of each member 18 defines a rebound zone with the ball following a general path of travel determined by the angle at which the ball hits the playing surface. The shallow, trough-like depressions 20 are provided near the center of the tabletop 14 to give the ball a trajectory very nearly the same as that which is obtained when the ball strikes near the outer rim of the tabletop. Thus, no matter where the ball strikes on the playing surface 16, the ball will be returned along a relative uniform path of travel. It is to be here noted that the curvature of each depression 20 is predetermined to cause a rebounding action very nearly consistent with that obtained when the ball strikes either of the flat areas 38 or 40 of the playing surface 16.

When the table 10 is to be used as a conventional table, as opposed for use as a game table, the sections 42 of each unit 34 are raised to present a circular tabletop as denoted by the numeral **14*a* in FIG. 3. The sections 42 are raised by simply swinging each respective hangle 46 in a downward and rearward direction and, while so doing, pushing up on the section 42, thereby swinging the same upwardly about an axis defined by the hinges 76 to assume a horizontal disposition. As the section 42 is swung upwardly, the brace 56 also moves upwardly and the hook 60 engages the crossbolt 74 at approximately the same time that a notch 84 in the arm 66 of the handle 46 engages the crossbolt 72, thus locking the section 42** in its second position.

The size of the cutout sections 42 of the members 18 are calculated so that the vertexes thereof come together at the center of the tabletop **14*a* while the remaining V-shaped segment of each member 18 remains in its sloping, inclined disposition on the sub-panel 36. The outer portions of the members 18 which extend beyond the crosspiece 32 not only provide additional playing surface when the tabletop 14 is in its game-playing position, but also result in the tabletop 14*a* having its circular configuration when the sections 42** are raised to their horizontal positions.

When the table 10 is to be returned to its original, normal game-playing position it is but a simple matter to grasp the handle 46 of each unit 34 and pull back and down thereon to lower the section 42. Disengagement of the hook 60 from the crossbolt 74 is accomplished automatically by the abutment 68 of the lever 62 pushing the hook 60 off of the crossbolt 74 as the lever 62 is pulled along with the handle 46, by virture of the loop 64 around the arm 66, as the handle swings back toward its clip 52. The lever 62 is slidably supported by its two mounting clips 86 so that of will freely reciprocate along the center rib 30 in response to the movement of the handle 46.

Each trough-like depression 20 is formed in its respective section 42 by virture of the arm 66 being pulled against the upper crossbolt 70 which serves as a fulcrum point to pull the bracket 48 firmly downwardly such that the section 42 fits snugly against the sub-panel 36, while the grooves 78 permit the playing surface 16 to deform following the curvature of the upper edges of the ribs 30 and sub-panel 36. The grooves 78 not only permit the formation of the trough-like depression but also make it possible for the section 42 to assume its flat condition when it is shafted to its second position for use as a conventional tabletop.

The game table 10 may also be separated to present four individual game tables simply be removing the fasteners 80 so that each unit 34 becomes an independent, self-supporting table in which the respective member 18 defines a separate tabletop on an inclined plane to present a rigid playing surface having a sloping disposition. When so used, either one or two players position themselves to face the game table and then simply direct a ball toward the playing surface and then alternately hit the ball if two people are playing. If the table is to be converted to use as a conventional table, the process of raising the section 42 is the same as that previously described as in the changing of the table back to its normal, game-playing disposition.

Having thus described the invention, what is claimed as new and desired to be secured by Letters Patent is:

1. A game table comprising:

a support and a tabletop secured to said support, said tabletop being in a fixed disposition relative to said support and defining an inverted prism having a lowermost apex at the center of the tabletop spaced substantially below the periphery of the latter to present a plurality of discrete, generally triangular, upwardly facing, steeply inclined playing surfaces sloping upwardly and outwardly from said center to the periphery of the tabletop when the latter is in its normal game-playing disposition, each of said playing surfaces also being configured to present a shallow, elongate, open-ended trough-like depression having a rectilinear longitudinal axis and extending across the respective surface transversely of the inclined slipe thereof;

said playing surfaces being smooth and rigid to define a rebound zone for a ball when the latter is caused to strike said playing surfaces.

2. A game table as claimed in claim 1, wherein said playing surfaces each include an uppermost flat area and a lowermost arcuate portion.

3. A game table as claimed in claim 2, wherein each of said arcuate portions defines said shallow, elongate, open-ended trough-like depression .

4. A game table as claimed in claim 1, wherein said depressions are in a common horizontal plane and in horizontal alignment with one another.

5. A game table comprising:

a support; and a tabletop secured to said support, said tabletop being in a fixed disposition relative to said support and having a recessed center to present an upwardly facing, inclined playing surface sloping upwardly and outwardly from said center to the periphery of the tabletop when in its normal game playing disposition, said playing surface being smooth and rigid to define a rebound zone for a ball when the latter is caused to strike said playing surface, said tabletop comprising a plurality of generally triangularly-shaped members in an adjacent relationship with one another, said members having their respective vertexes at said center of the tabletop such that the members present a plurality of generally opposed playing surfaces, said game table being separable into a plurality of self-supporting independent units, each of said units having at least one of said members associated therewith.

6. A game table comprising:

a support; and a tabletop secured to said support, said tabletop being in a fixed disposition relative to said support and having a recessed center to present an upwardly facing, inclined playing surface sloping upwardly and outwardly from said center to the periphery of the tabletop when in its normal playing disposition, said playing surface being smooth and rigid to define a rebound zone for a ball when the latter is caused to strike said playing surface, said tabletop comprising a plurality of generally triangularly-shaped members in an adjacent relationship with one another, said members having their respective vertexes at said center of the tabletop such that the members present a plurality of generally opposed playing surfaces, each of said members having at least a section thereof that is swingable relative to said support from a normal, game-playing position to a second position each section having at least a substantial area of the playing surface of its respective member; and means for releasably positioning each of said sections in said second position with the respective playing surfaces being in a generally uniform, horizontal, planar disposition relative to one another when the sections are so positioned whereby the game table may be used as a conventional table.

7. A game table as claimed in claim 6, wherein the playing surface of each section is flat when the same is in its respective horizontal disposition, and wherein at least a portion of the playing surface of each member is a shallow, elongate, open-ended trough-like depression extending across the playing surface of each member transversely of the inclined slope thereof when the member is in its normal, game-playing position, there being means associated with each section for deforming the playing surface thereof from said flat condition when the section is in said second position to prevent said depression when the section is shifted to its normal game-playing position.

8. A game table comprising:

a support; and a tabletop secured to said support, said support having structure arranged to position said tabletop in a fixed disposition relative to said support and on an inclined plane to present said tabletop in a sloping disposition when in its normal game playing disposition, said tabletop including a smooth and rigid playing surface on said inclined plane with the playing surface defining a rebound zone for a ball when the latter is caused to strike said playing surface, said playing surface having at least one flat area and an arcuate portion presenting a shallow, elongate, open-ended trough-like depression extending across the playing surface transversely of said inclined plane, said tabletop being generally triangular in shape when viewed in plan with the vertex thereof being at the lowermost end of the playing surface.

9. A game table as claimed in claim 8, wherein said tabletop has a section of said playing surface that is swingable relative to said support from a normal game-playing position to a second position, said section having at least a substantial area of said playing surface; there being means for releasably retaining said section in said second position with the playing surface thereof being in a generally horizontal disposition when said section is in said second position whereby the game table may be used as a conventional table.

10. A game table as claimed in claim 9, wherein substantially the entire area of said playing surface of said section is flat when the same is in said second position there being means associated with said section for deforming said playing surface thereon from said flat condition when the section is in said second position to present said depression when the section is shifted to its normal, game-playing position.

* * * * *